US006778151B2

(12) United States Patent
Li

(10) Patent No.: US 6,778,151 B2
(45) Date of Patent: Aug. 17, 2004

(54) DRIVING CIRCUIT OF DISPLAY CAPABLE OF PREVENTING CHARGE ACCUMULATION

(75) Inventor: Chun-Huai Li, Pingtung Hsien (TW)

(73) Assignee: Au Optronics Corporation, Hsinchu (TW)

( * ) Notice: Subject to any disclaimer, the term of this patent is extended or adjusted under 35 U.S.C. 154(b) by 182 days.

(21) Appl. No.: 10/065,092

(22) Filed: Sep. 17, 2002

(65) Prior Publication Data

US 2004/0012545 A1 Jan. 22, 2004

(30) Foreign Application Priority Data

Jul. 19, 2002 (TW) ..... 91116088 A

(51) Int. Cl.[7] ..... G09G 3/20

(52) U.S. Cl. ..... 345/55; 345/76; 345/82; 315/169.1; 315/169.3

(58) Field of Search ..... 345/39–55, 76–84; 315/169.1, 169.3, 169.4

(56) References Cited

U.S. PATENT DOCUMENTS 5,952,789 A * 9/1999 Stewart et al. ..... 315/169.4
5,966,106 A * 10/1999 Yamazaki ..... 345/45
5,966,110 A * 10/1999 Van Zalinge ..... 345/82
6,535,185 B2 * 3/2003 Kim et al. ..... 345/76
6,633,285 B1 * 10/2003 Kigo et al. ..... 345/204
6,636,191 B2 * 10/2003 Cok ..... 345/82
6,650,060 B2 * 11/2003 Okuda ..... 315/169.1
6,661,379 B2 * 12/2003 Stilp et al. ..... 342/457
6,670,773 B2 * 12/2003 Nakamura et al. ..... 315/169.3
6,690,115 B2 * 2/2004 Kim et al. ..... 315/169.1
2003/0016191 A1 * 1/2003 Nakamura et al. ..... 345/55
2003/0067424 A1 * 4/2003 Akimoto et al. ..... 345/55
2003/0107534 A1 * 6/2003 Koyama et al. ..... 345/76

* cited by examiner

*Primary Examiner*—Richard Hjerpe
*Assistant Examiner*—Kimnhung Nguyen
(74) *Attorney, Agent, or Firm*—Jiang Chyun IP Office

(57) ABSTRACT

A driving circuit for driving a display and capable of preventing charge accumulation is provided. This invention provides two additional thin film transistors to the driving circuit of each pixel of the display. If, during fabrication, positive charges accumulate at the anode of a light-emitting diode so that the anode has a potential larger than the common positive voltage line of the panel, a current will flow from one of the thin film transistors to the common positive voltage line. Conversely, if negative charges accumulate at the anode so that the anode has a potential smaller than the common negative voltage line of the panel, a current will flow from the common negative voltage line to the anode via the other thin film transistor and neutralize the negative charges. If the charges are not neutralized and allowed to accumulate on the anode of the light-emitting device, point defects may be produced.

18 Claims, 3 Drawing Sheets

DRIVING CIRCUIT OF DISPLAY CAPABLE OF PREVENTING CHARGE ACCUMULATION

CROSS REFERENCE TO RELATED APPLICATIONS

This application claims the priority benefit of Taiwan application serial no. 91116088, filed Jul. 19, 2002.

BACKGROUND OF INVENTION

1. Field of Invention

The present invention relates to the driving circuit of a display. More particularly, the present invention relates to the driving circuit of a display capable of preventing charge accumulation.

2. Description of Related Art

People are always interested in watching recorded images and movies. Ever since the invention of cathode ray tube (CRT), television has become commercialized and television sets are owned by almost every family. With rapid progress in technology, the CRT has been used for many applications including the desktop monitor of a personal computer. However, due to radiation hazards and the bulkiness of the electron gun, the CRT display is hard to make lighter and flatter.

Because of intrinsic bulkiness, researchers are now developing more slim-line displays. The so-called "flat panel displays" now include liquid crystal displays (LCDs), field emission displays (FEDs), organic light-emitting diode (OLED) displays and plasma display panel (PDP) displays.

The organic light-emitting diode (OLED) is also known as an organic electroluminescence display (OELD) due to its self-illuminating character. OLED is driven by a low DC voltage and has properties including high brightness level, high energy efficiency, high contrast values as well as slim and lightweight. Moreover, the display is able to emit light of a range of colors from the three primary colors red (R), green (G) and blue (B) to white light. Hence, OLED is considered to be the display panel of the next generation. Aside from having high resolution and light just like the LCD and having self-illuminating capacity, a quick response and a low energy consumption just like the LED, OLED also has other advantages including a wide viewing angle, good color contrast and a low production cost. Thus, OLED is often used in LCD or as a background light source for indicator panels, mobile phones, digital cameras and personal digital assistants (PDA).

According to the type of driver selected to drive the OLED, the OLED can be divided into passive matrix driven or active matrix driven type. Passive matrix OLED has the advantage of structural simplicity and a low production cost. However, the passive matrix OLED has a relative low resolution rendering it unsuitable for producing high-quality images. Moreover, the passive matrix OLED consumes a lot of power, has a shorter working life and sub-optimal displaying capacity. On the other hand, although the active matrix OLED is slightly more expensive to produce, it can be assembled to form a huge screen, aside from having a large viewing angle, the capacity for producing high brightness level and a quick response.

According to the driving method, a flat display panel is divided into a voltage-driven type or a current-driven type. The pixel circuit of a conventional voltage-driven type of active matrix OLED is shown in FIG. 1. As shown in FIG. 1, the pixel circuit 10 includes a driving circuit 102 and an OLED (104). The driving circuit 102 further includes a thin film transistor TFT1 (106), a storage capacitor C (108) and a second thin film transistor TFT2 (110). The drain terminal of the transistor TFT1 (106) is coupled to a data line. The gate terminal of the transistor TFT1 (106) is coupled to a scanning line. The drain terminal of the transistor TFT1 (106) is coupled to a first terminal of the capacitor C (108) and the gate terminal of the transistor TFT2 (110). The drain terminal of the transistor TFT2 (110) is coupled to a voltage source V+, wherein the voltage V+ is a positive voltage. The source terminal of the transistor TFT2 (110) is coupled to the second terminal of the capacitor C (108) and the anode of the OLED (104) (also known as indium-tin-oxide, ITO). The cathode of the OLED (104) is coupled to another voltage source V−. The voltage V− is a negative voltage or a ground potential. In FIG. 1, after forming the substrate of the transistor TFT1 (106) and the transistor TFT2 (110), an OLED (104) film is plated over the substrate. Hence, some electric charges are trapped on the anode of the OLED (104). If too many electric charges accumulate on the anode of the OLED of a particular pixel, that pixel no longer lights up leading to a point defect. In general, tens and sometimes hundreds of point defects are found within an area 50 $cm^2$ of a display panel. When a large number of point defects appears on a display panel, quality of the image will be greatly compromised.

SUMMARY OF INVENTION

Accordingly, one object of the present invention is to provide the driving circuit of a display capable of preventing charge accumulation. Two thin film transistors are added to the driving circuit of each pixel of the display so that electric charges accumulated at the anode of a light-emitting diode during fabrication are dissipated and hence very few point defects are produced.

To achieve these and other advantages and in accordance with the purpose of the invention, as embodied and broadly described herein, the invention provides the driving circuit of a display capable of preventing charge accumulation. The driving circuit drives a light-emitting device that has an anode and a cathode. The driving circuit includes a first transistor, a second transistor, a third transistor and a fourth transistor. The first transistor has a drain terminal, a gate terminal and a source terminal. The drain terminal of the first transistor is coupled to a data line. The gate terminal of the first transistor is coupled to a scanning line. The storage capacitor has a first terminal and a second terminal. The first terminal of the capacitor is coupled to the source terminal of the first transistor. The second terminal of the capacitor is coupled to the anode of the light-emitting device. The second transistor has a drain terminal, a gate terminal and a source terminal. The drain terminal of the second transistor is coupled to a first voltage source. The gate terminal of the second transistor is coupled to the source terminal of the first transistor and the first terminal of the capacitor. The source terminal of the second transistor is coupled to the anode of the light-emitting device and the second terminal of the capacitor. The third transistor has a drain terminal, a gate terminal and a source terminal. The drain terminal of the third transistor is coupled to the first voltage source and the drain terminal of the second transistor. The gate terminal of the third transistor is coupled to the source terminal of the third transistor, the anode of the light-emitting device and the second terminal of the transistor. The fourth transistor has a drain terminal, a gate terminal and a source terminal. The drain terminal of the fourth transistor is coupled to the gate terminal of the third transistor, the source terminal of the third transistor, the source terminal of the second transistor, the anode of the light-emitting device and the second terminal of the capacitor. The gate terminal of the fourth transistor is coupled to the source terminal of the fourth transistor, the cathode of the light-emitting diode and the second voltage source. During normal operation, the first voltage source is at a greater voltage than the anode and the second voltage source is at a smaller voltage than the anode.

In one embodiment of this invention, the third transistor is an N-type thin film transistor or a P-type thin film transistor.

In one embodiment of this invention, the fourth transistor is an N-type thin film transistor or a P-type thin film transistor.

In one embodiment of this invention, the display is an active matrix organic electroluminescence display.

In one embodiment of this invention, the first voltage and the second voltage are provided through a power supplier.

In one embodiment of this invention, the light-emitting device includes an organic light-emitting diode or a polymeric light-emitting diode.

The invention also provides a display capable of preventing charge accumulation. The display includes a plurality of pixels. Each pixel includes a first transistor, a storage capacitor, a second transistor, a third transistor, a fourth transistor and a light-emitting device. The first transistor has a drain terminal, a gate terminal and a source terminal. The drain terminal of the first transistor is coupled to a data line. The gate terminal of the first transistor is coupled to a scanning line. The storage capacitor has a first terminal and a second terminal. The first terminal of the capacitor is coupled to the source terminal of the first transistor. The second transistor has a drain terminal, a gate terminal and a source terminal. The drain terminal of the second transistor is coupled to a first voltage source. The gate terminal of the second transistor is coupled to the source terminal of the first transistor and the first terminal of the capacitor. The source terminal of the second transistor is coupled to the second terminal of the capacitor. The third transistor has a drain terminal, a gate terminal and a source terminal. The drain terminal of the third transistor is coupled to the first voltage source and the drain terminal of the second transistor. The gate terminal of the third transistor is coupled to the source terminal of the third transistor, the source terminal of the second transistor and the second terminal of the capacitor. The fourth transistor has a drain terminal, a gate terminal and a source terminal. The drain terminal of the fourth transistor is coupled to the gate terminal of the third transistor, the source terminal of the third transistor, the source terminal of the second transistor and the second terminal of the capacitor. The gate terminal of the fourth transistor is coupled to the source terminal of the fourth transistor and the second voltage source. The light-emitting device has an anode and a cathode. The anode is coupled to the second terminal of the capacitor, the source terminal of the second transistor, the source terminal of the third transistor and the gate terminal of the third transistor. The cathode is coupled to the second voltage source, the source terminal of the fourth transistor and the gate terminal of the fourth transistor. During normal operation, the first voltage source is at a greater voltage than the anode and the second voltage source is at a smaller voltage than the anode.

In brief, this invention provides two additional thin film transistors to the driving circuit of each pixel of the display. When positive electric charges accumulate at the anode of a light-emitting diode during fabrication so that the anode has a potential larger than the common positive voltage line of the panel, a current will flow from one of the thin film transistors to the positive voltage line. Conversely, when negative electric charges accumulate at the anode so that the anode has a potential smaller than the common negative voltage line of the panel, a current will flow from the common negative voltage line to the anode via the other thin film transistor to neutralize the negative charges. Therefore, very few electric charges will accumulate at the anode of the light-emitting device and hence very little point defects will appear on the display panel.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
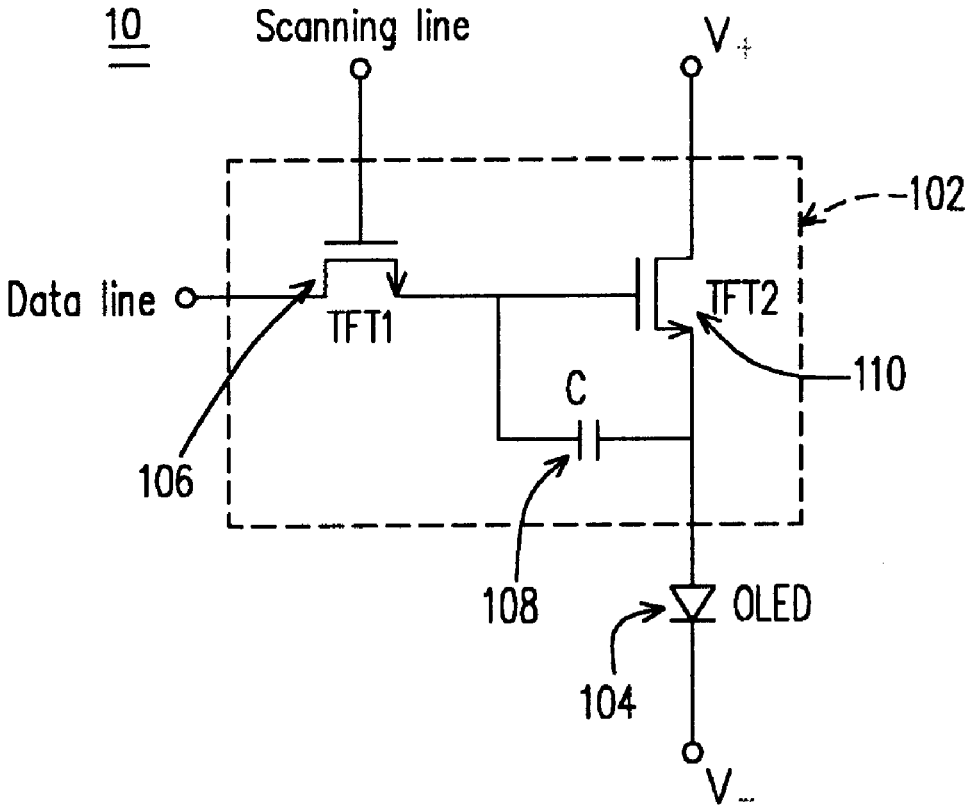
FIG. 1 (PRIOR ART)
FIG. 1 is a pixel circuit of a conventional voltage-driven type of active matrix OLED.

Reference will now be made in detail to the present preferred embodiments of the invention, examples of which are illustrated in the accompanying drawings. Wherever possible, the same reference numbers are used in the drawings and the description to refer to the same or like parts.

The purpose of this invention is to distribute pixel charges evenly to the entire display panel so that none of the pixels will accumulate too much electric charge to produce point defects. To distribute the charges evenly across the display panel, the anodes (that is, the ITO) of the light-emitting devices must have equal potential. However, when all the anodes are at an identical potential, the display panel no longer functions properly and hence proper images are not produced because the data integrated circuit cannot distinguish between different data voltages. This invention not only provides a means of distributing the electric charges evenly across the display panel, but also permits the display to function normally.

Figure 2:
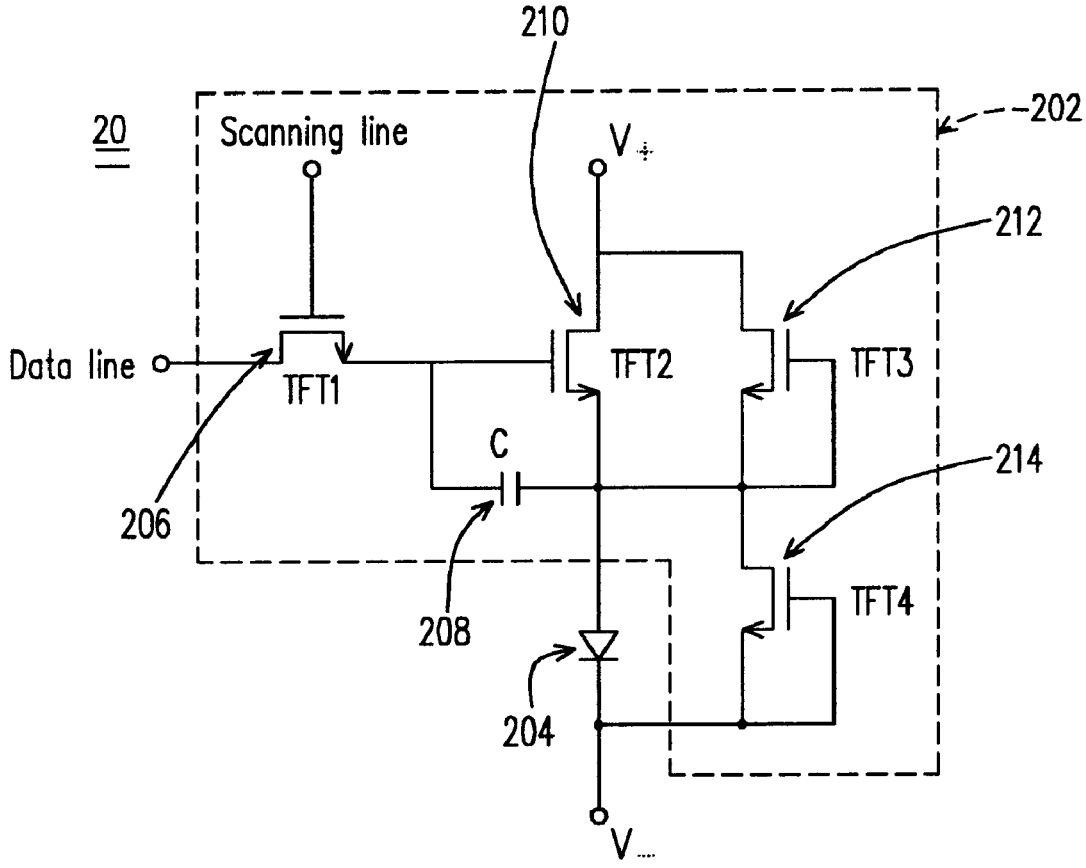
FIG. 2 is a pixel circuit of a display for preventing the accumulation of charges according to one preferred embodiment of this invention.

FIG. 2 is a pixel circuit of a display for preventing the accumulation of charges according to one preferred embodiment of this invention. As shown in FIG. 2, the pixel 20 includes a driving circuit 202 and a light-emitting device 204. The light-emitting device 204 can be an organic light-emitting diode or a polymeric light-emitting diode. The driving circuit 202 includes a first transistor TFT1 (206), a storage capacitor C (208), a second transistor TFT2 (210), a third transistor TFT3 (212) and a fourth transistor TFT4 (214). The third transistor TFT3 (212) and the fourth transistor TFT4 (214) can be N-type thin film transistors or P-type thin film transistors. The third transistor TFT3 (212) and the fourth transistor TFT4 (214) have a relatively small channel width/length ratio so that the opening rate of the pixel is largely unaffected. Note also that since the anode and the cathode of a light-emitting device in a passive organic electroluminescence display are arranged to form a row or a column, the electric charges are automatically distributed over the entire row or column and hence prevented from having any charge accumulation problem. Thus, this invention mainly applies to active organic electroluminescence displays.

In the following, the pixel circuit 20 is explained in greater detail. The first transistor TFT1 (206) has a drain terminal, a gate terminal and a source terminal. The capacitor C (208) has two terminals. The second transistor TFT2 (210) has a drain terminal, a gate terminal and a source terminal. Similarly, the third transistor TFT3 (212) and the fourth transistor TFT4 (214) each has a drain terminal, a gate terminal and a source terminal. The light-emitting device (204) has an anode and a cathode. The drain terminal of the first transistor TFT1 (206) is coupled to a data line. The gate terminal of the first transistor TFT1 (206) is coupled to a scanning line. The source terminal of the first transistor TFT1 (206) is coupled to a first terminal of the capacitor C (208) and the gate terminal of the second transistor TFT2 (210). The drain terminal of the second transistor TFT2 (210) is coupled to a voltage source V+ (the common positive voltage line of the panel) and the drain terminal of the third transistor TFT3 (212). The voltage V+ is a positive voltage provided by a power supplier. The source terminal of the second transistor TFT2 (210) is coupled to the other terminal of the capacitor C (208), the anode of the light-emitting device (204), the source and gate terminal of the third transistor TFT3 (212) and the drain terminal of the fourth transistor TFT4 (214). The gate terminal of the fourth transistor TFT4 (214) is coupled to the source terminal of the fourth transistor TFT4 (214), the cathode of the light-emitting device (204) and a negative voltage source V− (common negative voltage line of the panel). The voltage V− is a negative voltage or a ground potential provided by the power supplier.

Figure 3:
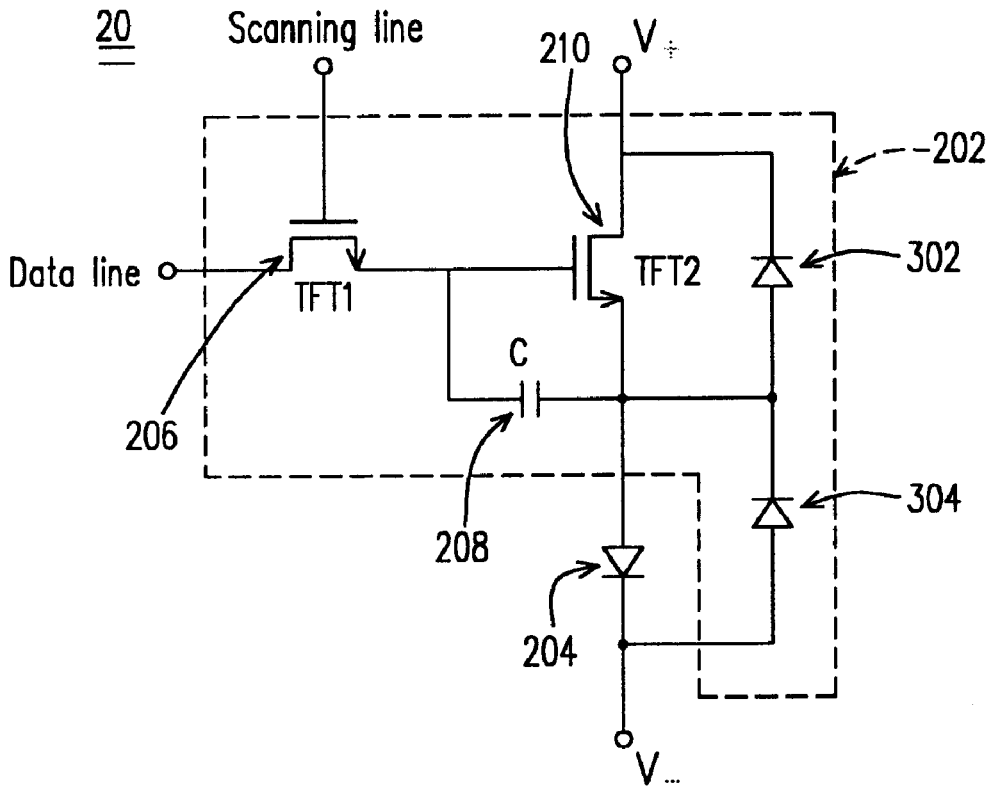
FIG. 3 is an equivalent circuit of the circuit shown in FIG. 2.

Since the third transistor TFT3 (212) and the fourth transistor TFT4 (214) act like diodes, the circuit in FIG. 2 is equivalent to the one in FIG. 3. As shown in FIG. 3, the third transistor TFT3 (212) is equivalent to the diode 302 and the fourth transistor TFT4 (214) is equivalent to the diode 304. The following is a description of the operation of the driving circuit 202. When the pixel 20 is operating normally, the anode of the light-emitting device (204) is at a potential between V+ and V− (that is, the anode of the light-emitting device (204) is at a voltage smaller than V+ but greater than V−). Hence, the third transistor TFT3 (212) and the fourth transistor TFT4 (214) will not conduct. The driving circuit 202 has a configuration similar to the one in FIG. 1 and hence functions identically without any problem. During the fabrication process, if the accumulated charges at the anode of the light-emitting device (204) are positive charges so that the anode is at a potential greater than V+, the third transistor TFT3 (212) will conduct, channeling the positive charges from the anode to the voltage source V+. Thus, the voltage source V+, the anode of the light-emitting device (204) and the voltage source V− are at the same potential. Conversely, if the accumulated charges at the anode of the light-emitting device (204) are negative charges so that the anode is at a potential smaller than V−, a current will flow from the voltage source V− via the fourth transistor TFT4 (214) to the anode and neutralize the negative charges. Hence, the voltage source V+, the anode of the light-emitting device (204) and the voltage source V− are at the same potential. Since electric charges are no longer trapped inside the anode of the light-emitting device (204), a reverse high electric between the anode and the cathode of the light-emitting device (204) will not form. Ultimately, the display is prevented from forming any point defects.

In summary, this invention provides two additional thin film transistors to the driving circuit of each pixel of the display. If, during fabrication, positive electric charges accumulate at the anode of a light-emitting diode so that the anode has a potential larger than the common positive voltage line of the panel, a current will flow from one of the thin film transistors to the common positive voltage line. Conversely, if negative electric charges accumulate at the anode so that anode has a potential smaller than the common negative voltage line of the panel, a current will flow from the common negative voltage line to the anode via the other thin film transistor and neutralize the negative charges. Since very few electric charges will accumulate at the anode of the light-emitting device, point defects will disappear from the display panel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving circuit for driving the light-emitting device a display and capable of preventing any accumulation of charges, wherein the light-emitting diode has an anode and a cathode, the driving circuit comprising:

a first transistor having a drain terminal, a gate terminal and a source terminal, wherein the drain terminal of the first transistor is coupled to a data line, and the gate terminal of the first transistor is coupled to a scanning line;

a storage capacitor having a first terminal and a second terminal, wherein the first terminal of the capacitor is coupled to the source terminal of the first transistor and the second terminal of the capacitor is coupled to the anode;

a second transistor having a drain terminal, a gate terminal and a source terminal, wherein the drain terminal of the second transistor is coupled to a first voltage source, the gate terminal of the second transistor is coupled to the source terminal of the first transistor and the first terminal of the capacitor, and the source terminal of the second transistor is coupled to the anode and the second terminal of the capacitor;

a third transistor having a drain terminal, a gate terminal and a source terminal, wherein the drain terminal of the third transistor is coupled to the first voltage source and the drain terminal of the second transistor, and the gate terminal of the third transistor is coupled to the source terminal of the third transistor, the anode and the second terminal of the capacitor; and a fourth transistor having a drain terminal, a gate terminal and a source terminal, wherein the drain terminal of the fourth transistor is coupled to the gate terminal of the third transistor, the source terminal of the third transistor, the source terminal of the second transistor, the anode and the second terminal of the capacitor, and the gate terminal of the fourth transistor is coupled to the source terminal of the fourth transistor, the cathode and a second voltage source;

wherein the first voltage source is at a potential greater than the anode and the second voltage source is at a potential smaller than the anode during normal operation.

2. The driving circuit of claim 1, wherein the third transistor is an N-type thin film transistor.

3. The driving circuit of claim 1, wherein the third transistor is a P-type thin film transistor.

4. The driving circuit of claim 1, wherein the fourth transistor is an N-type thin film transistor.

5. The driving circuit of claim 1, wherein the fourth transistor is a P-type thin film transistor.

6. The driving circuit of claim 1, wherein the display is an active matrix organic electroluminescence display.

7. The driving circuit of claim 1, wherein the first voltage and the second voltage are provided by a power supplier.

8. The driving circuit of claim 1, wherein the light-emitting device is an organic light-emitting diode.

9. The driving circuit of claim 1, wherein the light-emitting device is a polymeric light-emitting diode.

10. A charge accumulation preventable display having a plurality of pixels therein with each pixel comprising:

a first transistor having a drain terminal, a gate terminal and a source terminal, wherein the drain terminal of the first transistor is coupled to a data line, and the gate terminal of the first transistor is coupled to a scanning line;

a storage capacitor having a first terminal and a second terminal, wherein the first terminal of the capacitor is coupled to the source terminal of the first transistor;

a second transistor having a drain terminal, a gate terminal and a source terminal, wherein the drain terminal of the second transistor is coupled to a first voltage source, the gate terminal of the second transistor is coupled to the source terminal of the first transistor and the first terminal of the capacitor, and the source terminal of the second transistor is coupled to the second terminal of the capacitor;

a third transistor having a drain terminal, a gate terminal and a source terminal, wherein the drain terminal of the third transistor is coupled to the first voltage source and the drain terminal of the second transistor, and the gate terminal of the third transistor is coupled to the source terminal of the third transistor, the source terminal of the second transistor and the second terminal of the capacitor;

a fourth transistor having a drain terminal, a gate terminal and a source terminal, wherein the drain terminal of the fourth transistor is coupled to the gate terminal of the third transistor, the source terminal of the third transistor, the source terminal of the second transistor and the second terminal of the capacitor, and the gate terminal of the fourth transistor is coupled to the source terminal of the fourth transistor and a second voltage source; and a light-emitting device having an anode and a cathode, wherein the anode is coupled to the second terminal of the capacitor, the source terminal of the second transistor, the source terminal of the third transistor and the gate terminal of the third transistor, and the cathode is coupled to the second voltage source, the source terminal of the fourth transistor and the gate terminal of the fourth transistor;

wherein the first voltage source is at a potential greater than the anode and the second voltage source is at a potential smaller than the anode during normal operation.

11. The display of claim 10, wherein the third transistor is an N-type thin film transistor.

12. The display of claim 10, wherein the third transistor is a P-type thin film transistor.

13. The display of claim 10, wherein the fourth transistor is an N-type thin film transistor.

14. The display of claim 10, wherein the fourth transistor is a P-type thin film transistor.

15. The display of claim 10, wherein the display is an active matrix organic electroluminescence display.

16. The display of claim 10, wherein the first voltage and the second voltage are provided by a power supplier.

17. The display of claim 10, wherein the light-emitting device is an organic light-emitting diode.

18. The display of claim 10, wherein the light-emitting device is a polymeric light-emitting diode.

* * * * *